US006199492B1

(12) United States Patent
Künstler

(10) Patent No.: US 6,199,492 B1
(45) **Date of Patent: *Mar. 13, 2001**

(54) PROCESS FOR MELTING DOWN COMBUSTION RESIDUES INTO SLAG

(76) Inventor: Johann Hans Künstler, Haslenweg 3, 8142 Uitikon Waldegg (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/580,960

(22) Filed: Dec. 29, 1995

Related U.S. Application Data

(63) Continuation-in-part of application No. 08/133,023, filed on Oct. 8, 1993, now abandoned.

(30) Foreign Application Priority Data

Feb. 26, 1992 (CH) ..... 591/92
Feb. 11, 1993 (WO) ..... PCT/CH93/00035

(51) Int. Cl.[7] ..... F23B 7/00; F23G 5/027; F23G 5/20

(52) U.S. Cl. ..... 110/342; 110/230; 110/246; 110/248; 110/344; 110/345; 110/346

(58) Field of Search ..... 110/259, 263, 110/266, 341, 344, 342, 346, 230, 235, 246, 255, 345, 248

(56) References Cited

U.S. PATENT DOCUMENTS 4,303,477 * 12/1981 Schmidt et al. ..... 201/2.5
4,354,440 * 10/1982 McRee, Jr. ..... 110/346
4,794,871 * 1/1989 Schmidt et al. ..... 110/246 X
4,878,440 * 11/1989 Tratz et al. ..... 110/346 X
5,044,288 * 9/1991 Barlow ..... 110/346
5,237,940 * 8/1993 Pieper et al. ..... 110/346
5,370,067 * 12/1994 Finet ..... 110/346
5,425,317 * 6/1995 Schaub et al. ..... 110/346
5,497,712 * 3/1996 May et al. ..... 110/342
5,592,888 * 1/1997 Berwein et al. ..... 110/229
5,724,900 * 3/1998 Tratz ..... 110/246 X
5,826,521 * 10/1998 Schumann et al. ..... 110/346 X

FOREIGN PATENT DOCUMENTS 0 495 766 A2 * 7/1992 (EP) .
55-140026 * 11/1980 (JP) ..... 110/246
PCT/DK91/00169 * 6/1991 (WO) .

OTHER PUBLICATIONS

Kunstler et al., The VS–Combination Reactor from Kupat AG, as translated into English by FLS, Inc., 1994.*
Kunstler et al., "Der VS–Kombi–Reaktor der Firma Kupat AG", Mull und Abfall, Issue 31 and 32, pp 67–72, 1994.*

* cited by examiner

*Primary Examiner*—Ira S. Lazarus
*Assistant Examiner*—Ljiljana V. Ciric
(74) *Attorney, Agent, or Firm*—Lowe Hauptman Gilman & Berner, LLP

(57) ABSTRACT

A process for incinerating waste material to produce slag without the addition of fuel other than the waste material begins with carbonizing the waste material in a low temperature process in a generator to produce carbonized solid material with a high energy content and flammable gases which are extracted from the waste material. The carbonization and temperature in the generator are controlled by limiting the supply of air to the material in the generator, the temperature being less than 1000° C. The carbonized waste material and the carbonization gases are delivered together to a furnace which is supplied with excess air. The carbonized material and carbonization gases are incinerated at a high temperature, typically 1400° C., in the furnace, thereby substantially completely incinerating burnable products in the furnace and melting materials which will not burn. The result is a glassy slag which binds therein materials such as heavy metals which could otherwise be pollutants. Materials from other sources can also be added to be incorporated in the slag, and the heat produced by the system can be used to maintain the carbonization in the generator and to generate electricity.

22 Claims, 3 Drawing Sheets

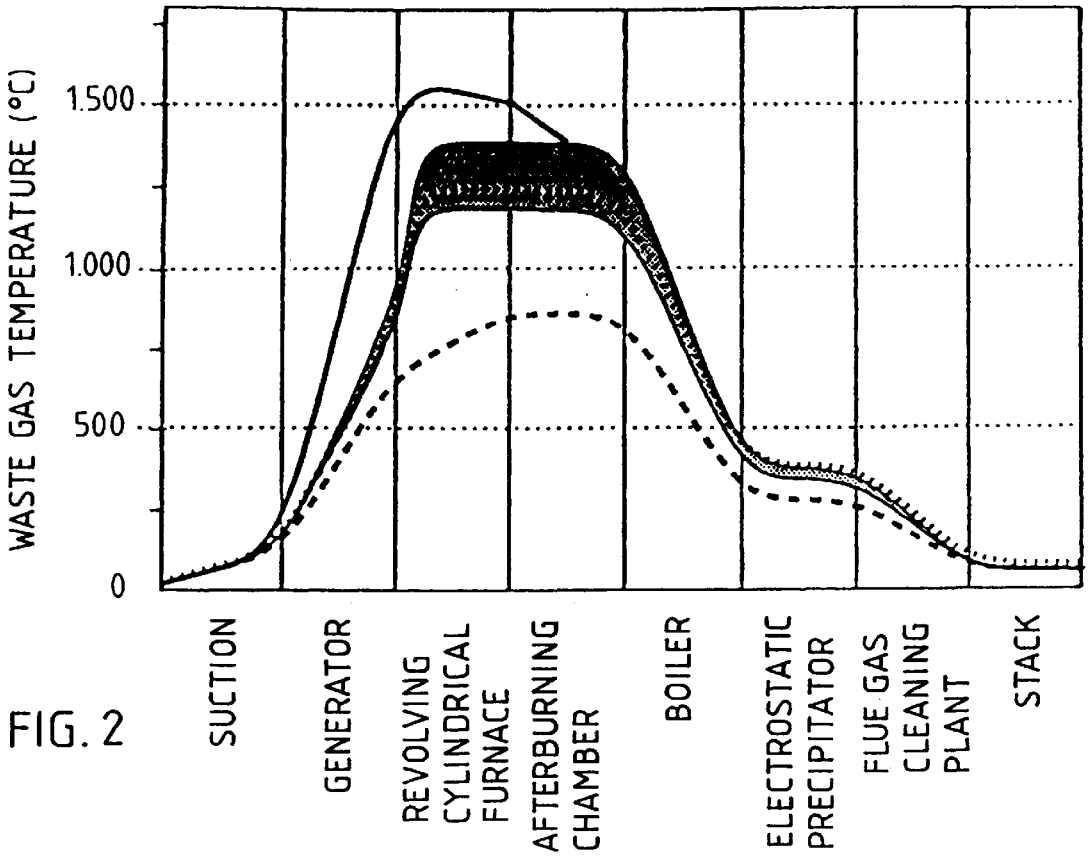
FIG. 2
FIG. 3
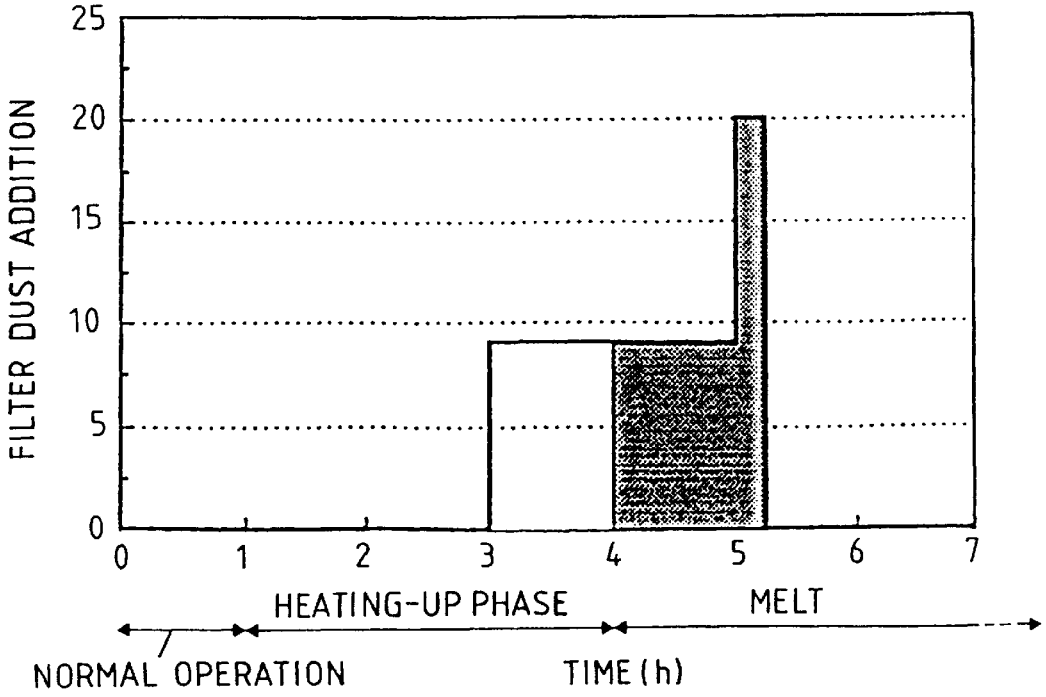

PROCESS FOR MELTING DOWN COMBUSTION RESIDUES INTO SLAG

CROSS-REFERENCE TO RELATED APPLICATION

This is a continuation-in-part of application Ser. No. 08/133,023 filed Oct. 8, 1993, and now abandoned.

FIELD OF THE INVENTION

This invention relates to a process for carbonizing and then incinerating waste materials, using the waste materials as a source of energy, to reduce the waste materials to slag which can be safely disposed of or reused.

BACKGROUND OF THE INVENTION

Fly ash, filter cake and slag from conventional incinerators, apart from unburned carbon, contain heavy metal compounds and organic hydrocarbons which can be washed out and can thereby become pollutants of water and soil. Legislation throughout the world is tending to require significant reductions in the quantity of such pollutants which can be released over a relatively short time scale so as to reduce the ecological toxic potential of slag and thereby permit safe storage, disposal or reuse. More stringent demands are also being made on other solid residues (e.g., flue dust and flue gas cleaning residues), and those residues which cannot be reused are to be processable into inert residual materials.

In general, the aim of present technologies is to reduce the volume of the non-reusable constituents with a view to keeping as small as possible the unavoidable residual material dumps. Space-intensive, environmentally safe residual material dumping of highly toxic residues proves to be very expensive, particularly if it is necessary to comply with legal requirements concerning long-term safety.

In standard grate furnaces for domestic refuse, it has hitherto not been possible to burn or incinerate at a sufficiently high temperature, quite apart from undesired local heating, such that during burning there is a melting down process of the combustion slag which results in permanent binding of heavy metals and complete burning off of organic or highly toxic compounds. Experience has shown that during slag fluidization the grates tend to be stuck during combustion, or the fluidized slag flows through the gaps in the grates. In other words, neither the presently known combustion processes, nor the plants currently in operation, are suitable for such a procedure. In the few plants involving a combination of a grate furnace with a revolving cylindrical furnace, it has hitherto been impossible to melt down slag because, in the grate furnace portion, total combustion of the waste is sought and achieved, thus leaving insufficient available energy in the revolving furnace portion to melt down the incinerated waste into slag. In addition, the revolving cylindrical furnaces do not have the necessary characteristics and equipment for drawing off the molten slag. Such furnaces are only used for complete burning off of the slag. In some special refuse disposal systems, the waste materials are burned in special refuse revolving cylindrical furnaces at very high temperatures using additional energy supplied from outside sources. In these systems, the slag problem is of a minor nature, but the systems are expensive to construct and operate because of the need for added energy.

SUMMARY OF THE INVENTION

An object of the present invention is to reduce the environmental burden of solid waste materials by providing a process for effectively reducing materials such as solid waste, flue dust, potash and other toxic substances into inert slag.

A further object is to provide such a process in which incinerated materials which would otherwise be environmentally harmful end up as an effectively condensed and bound, environmentally harmless material which can be disposed of, e.g., as a TVA inert residue in accordance with the requirements of the regulations governing waste materials in Switzerland, or instead of being dumped, can be employed for a useful purpose.

Briefly described, the invention comprises a substantially thermally closed-cycle method for melting residual substances from waste material combustion into environmentally inert slag comprising the steps of delivering waste materials to a generator comprising a feed grate and a feed means, in a first, low temperature process, substoichiometrically carbonizing the waste materials in the generator using the energy in the waste material for the carbonizing to produce carbonized material having a high energy content and carbonization gases, transferring all of the carbonized material and carbonization gases from the generator to a furnace with additional air for supporting a high temperature incineration, incinerating in the furnace the carbonized material and the carbonization gases at a high temperature in the furnace without the addition of fuel other than the carbonized material and carbonization gases, thereby forming a slag with substantially no combustible materials therein, collecting heat from the furnace, and returning the collected heat to the generator to enhance carbonizing of materials therein.

The process according to the invention makes it possible to melt down into slag waste materials, flue dust and potash through the energy content of the supplied waste materials. Heavy metal compounds contained in the input materials are immobilized, ignition loss is reduced to a minimum, organic hydrocarbon compounds are lowered to below the present detection limit and specific volumes are greatly reduced. The fundamental idea of the process of the invention is, instead of complete initial incineration or combustion of waste as has heretofore been sought, to initially carry out in a low temperature unit a substoichiometric carbonization of the input material and then, using the carbonized solid materials and the gases which result from the carbonization process, to perform in a high temperature stage a complete combustion or incineration of the resulting materials to cause slag fluidization.

In this process, the materials resulting from the carbonization process contain more combustion energy than the residues resulting from conventional incineration processes and can be supplied to a slag fluidization stage, such a revolving cylindrical furnace, for formation of fluidized slag. Of the energy recovered by gasification, all or part can be supplied to slag fluidization in gaseous form so that the process can be controlled or regulated in a relatively simple manner. The end product of the process is then a completely burned-out, fluid slag which can be allowed to solidify in any chosen form.

BRIEF DESCRIPTION OF THE DRAWINGS

The invention is described in greater detail hereinafter with reference to the following drawings wherein:

FIG. 2 is a graph of temperature gradient in the reactor as measured in a test plant;

FIG. 3 is a time diagram showing the process of addition of extraneous material for melting down into slag, filter dust being used as an example.

DESCRIPTION OF THE PREFERRED EMBODIMENTS

Figure 1:
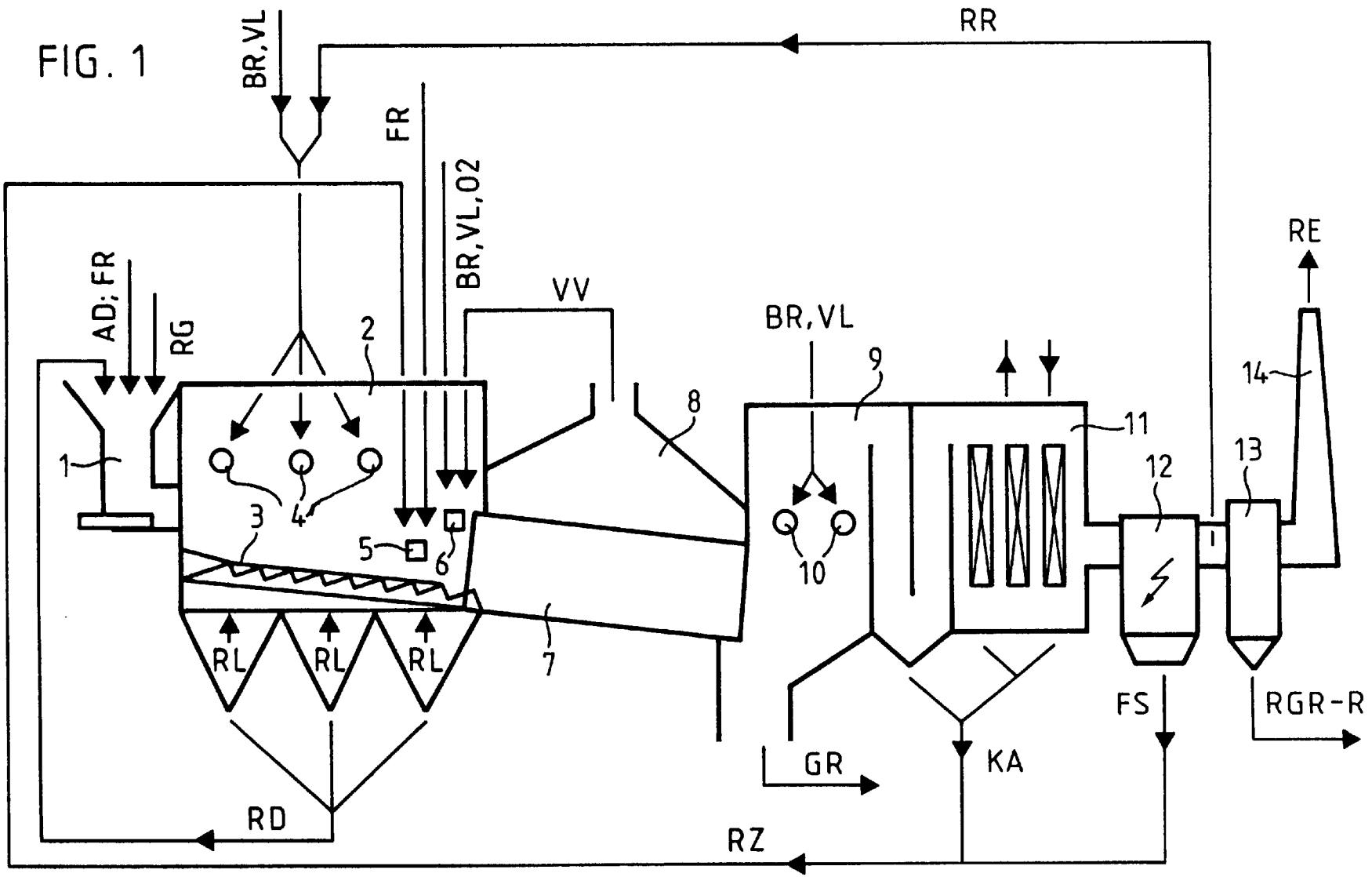
FIG. 1 is a schematic side elevation of an entire waste reduction plant for performing a process in accordance with the invention including a reactor operable with waste materials with boiler and flue gas cleaning.

The reactor shown in FIG. 1 is constructed with commercially available, tried and tested plant components. From the process engineering standpoint, the components are so coupled and connected in series that the desired process can be performed. The process proceeds from left to right in the apparatus shown in the drawing which includes a feed and charging station 1 for receiving the refuse material to be processed with means for delivering the refuse material to a carbonization grate 3 in a generator 2. In generator 2, the refuse is carbonized with a substiochiometric air supply, i.e., with insufficient oxygen to permit full incineration, thereby controlling the temperature at a low level below 1000° C. and converting the material into carbonized solid materials and gases which will constitute an energy carrier for the subsequent process. In the generator are the carbonization feed grate 3 as well as nozzles or jets 4 and feed means 5 and 6.

Following the generator is a revolving cylindrical furnace 7 which has a gas/air collecting hood 8. Furnace 7 receives the carbonized solid materials from generator 2 along with the gases from generator 2 and additional air for complete combustion of these materials and melting into slag. Furnace 7 is followed by an afterburning chamber 9 with a feed device 10 for supplying additional air for burning any remaining flammable constituents, a flue for removal of the flue gases, and means for removal of the afterburning chamber residuals GR, as shown in FIG. 1. The gaseous products of this system are delivered to a sequence of boilers 11 for reducing the temperature of the gases and for utilizing the heat of the flue gases. Thermal energy can be recovered from these boilers by using the heat to create steam and generate electricity, for example. An electrostatic precipitator 12 and flue gas cleaning apparatus 13 follow boilers 11 for cleaning the flue gases. Finally, a stack 14 leads the cleaned flue gases RE into the atmosphere.

Initially, refuse or waste material is delivered to grate 3 in generator 2 wherein the material is partially combusted and degasified in the substiochiometric medium. In this stage of the process, the material is carbonized and preheated. Because the process in the generator take place with much smaller air quantities, especially smaller undergrate quantities, as compared with a conventional waste incineration process, far fewer hot spots are formed in local areas which greatly reduces the NOx emissions in the order of 50% to 70%.

The revolving cylindrical furnace is connected to the generator and receives the materials for melting into slag. At the transition from the generator to the furnace, air is jetted into the furnace under well-controlled conditions and in a well-distributed manner. In the same transition region, externally supplied materials can be introduced into the process for combination with the carbonized materials from the generator. These externally supplied materials can be recirculated flue dust, slag and flue dust from other plants and other materials which do not require carbonization. In the furnace, there is combustion of the carbonization gases produced in the generator along with burning of the solid materials. As a result of the energy liberated by the complete combustion of these materials, the temperature in the rotating cylindrical furnace is raised to above the slag melting point and all of the solids (internal slag and externally supplied materials) are fluidized. The agitation of the materials in the revolving furnace leads to thorough mixing, homogenization and good burn-off. The slag flows out of the slightly inclined furnace into a pre-cooler and then into a deslagging means.

For complete combustion of the flue gases, secondary air is added to the gases in the afterburning chamber and the residence time of the gases in this chamber leads to completely satisfactory burning off of these gases. In place of secondary air, additional flue gases or recirculated vapors can be injected. The boiler of the reactor must be designed for the higher temperatures of this process. By using large radiation surfaces and a long gas path, the flue gas temperature up to the first convection part is lowered to below the flue dust softening point.

Following the boiler, the reactor can be equipped with commercially available gas cleaning components such as dust filters, washers/scrubbers, denox and dioxin separators and the like. Compared with conventional refuse incinerators, these components can be designed for much lower gas volume flows. Because in a conventional plant, the end temperatures of the combustion process are lower than in the process of the invention, higher gas quantities result. Thus, in the process according to the invention, the plant efficiency is higher than in conventional refuse incinerators.

More specifically, the present reactor essentially comprises a combination of a closed gas-producing generator with a mechanical feed grate 3, a following revolving cylindrical furnace 7 and a plurality of process-influencing connections such as connections for the addition of materials, gases, feedback material lines, and the like. These are followed by the standard flue gas cleaners and an apparatus for discharging the molten slag. These components also have process-influencing feedbacks to the generator/revolving cylindrical furnace.

As shown in FIG. 1, the process path starts at the charging intake 1 into which are introduced solid and liquid waste RG, additives AD, recycled riddlings RD, recirculated material RZ (comprising afterburning chamber residuals GR, potash KA, and filter dust FS), and materials FR from external sources (e.g., materials from other refuse incinerators for melting down). These substances pass onto feed grate 3 where, accompanied by the addition of further materials such as grate air RL, vapors BR, carbonization air VL, external materials FR and oxygen-containing gases O2, they are carbonized and gasified but are not incinerated. This is accomplished by controlling the quantity of grate air RL such that the quantity is substoichiometric and is very slowly blown in. It is possible to add through a plurality of air nozzles or jets 4 recirculated flue gas RR, vapors BR and carbonization air VL. Solid residual materials such as potash KA, filter dust FS and other externally supplied materials FR can be introduced through an inlet 5 and a preheated gas/air mixture VV from a collecting hood 8 in furnace 7, vapors BR combustion air (better gasification or carbonization air) VL and an oxygen-containing gas O2 such as air can be introduced through an inlet 6.

In this system, no additional energy supply is required for the actual process beside that from the solid waste, air supply and for the drive units, i.e., no fuel is added.

Materials such as the additional and residual materials mentioned above can also be added as ballast for planned modification of the composition of the carbonized product at the time of charging. In the afterburning chamber 9 following the revolving cylindrical furnace are inlets for feeding in combustion air VL or vapors BR. Apart from bringing about process control, these measures minimize heat loss, particularly in a vacuum-operated revolving cylindrical furnace which almost always has leaks. Very high process efficiency can be obtained with planned recycling of unprocessed energy-containing materials and thermal energy.

The addition of potash KA and filter dust FS at the transition from generator 2 to furnace 7 is desirable so that the flue dust is not immediately discharged in the flue gas by the generator air passing through the grate.

As the preheated and partly degasified solid residual materials from the generator pass into the revolving furnace, the air and other gases introduced into the generator and at the transition from the generator to the furnace create a positive pressure and a gas flow which transports the gaseous carbonization products into the furnace, creating a feed-forward of these flammable gases into the high-temperature stage of the system. The flammable gases contribute to the high temperature in the furnace which leads to a complete burn-off and melting of the material delivered to the furnace which are discharged from the furnace in molten form. During the melting, all of the organic products are destroyed at the 1300–1400° C. temperature in the furnace and any heavy metals are permanently bound into the glass structure of the slag. Only a small amount of the bound heavy metals are at the surface of the slag.

As mentioned above, most known slag and residual material melting processes require an energy supply from the outside, such as electricity or by expending fossil fuels. The addition of such energy is unnecessary in the process of the invention. Because of the special arrangement and air circulation in the system, the energy content of the input waste material is used so efficiently that it is adequate to melt down the reaction products of the generator, together with any added materials, in the subsequent furnace.

Because the waste materials which are the inputs to the system vary significantly in composition and calorific values, it is not possible to specifically define the exact characteristics of the process in terms of exact figures. The supply of input air and other constituents described above are varied to correspond to these changing characteristics and to maintain a system using the process in an efficient operating state.

FIG. 2 shows the approximate temperature gradient of the process in the reactor which starts at the charging intake 1 where the material is still at ambient temperature. Considered in the process direction, at the beginning of input grate 3, the temperature is in the few hundreds of degrees Celsius and rises, with increasing carbonization and gasification of the material, toward the end of the grate to as much as 1000°C. but without forming significant hot spots. The carbonization temperature is controlled by planned additions of grate air RL below the grate and by additions of vapors BR and/or carbonization air VL. At the input end of revolving cylindrical furnace 7, the temperature rises rapidly as the result of the ignition of the carbonization gases into the high temperature range between about 1200 and 1400° C. Complete incineration and melting take place in this range. At the transition point to the afterburning chamber, the temperature remains substantially the same due to the continued supply of combustion air and then is lowered toward about 1100° C. due to the controlled introduction of additional combustion air VL and/or vapors BR. In the boiler 11, the flue gases are cooled to about 200° C.

From the temperature chart it will be seen that very high temperatures above about 1000° C., at which slag starts to melt and at which plant parts not designed for such temperatures can be damaged, can be displaced from the grate to a later point of the process in the furnace which is designed for these temperatures. This not only applies to the combustion being delayed to a different location but also to the transfer of the energy carrier to this location. In this case, it is flammable gases which emanate from the carbonization on the grate and which, in the furnace together with the still burnable but degasified residues, permit the desired high temperatures. The substoichiometric carbonization can be largely or even completely supported by feedback of the recovered, recycled thermal energy from hood 8 of the furnace.

Tests on a Modified Plant

On a trial basis, it is not practical to readily construct a plant or to convert an existing plant. However, an object of the invention is to provide a process which can be performed using proven, commercially available plant or incinerator parts.

For testing the process, a specially selected plant was matched to a reactor according to the invention. Various deficiencies were accepted as being unavoidable for this testing. Thus, the waste charging quantity, i.e., the energy carrier necessary for slag fluidization was difficult to regulate. The ratio between the carbonization and combustion air could only be approximately regulated. The injection of combustion and burnoff air could only take place in part in the correct quantity and in well-distributed form. It was also necessary to ensure the operational safety of the plant.

Despite these limitations, it was possible during several tests to achieve in the revolving cylindrical furnace the temperatures necessary for slag melting. The calorific value was measured on average as $H_u$=10,890 kJ/kg. On the basis of these findings for reactors according to the invention with a controllable air supply, the process can be operated with a minimum calorific value of about 7,500 kJ/kg. By preheating of the combustion air and the addition of fluxes which reduce the slag melting point and increase the binding of heavy metals, it is possible to process refuse with still lower calorific values. No presorting or comminution of domestic refuse took place. However, it would be desirable to eliminate certain fractions such as, e.g., metals.

Something further must be taken into specific consideration. It is possible with the process according to the invention to melt down in the same process materials such as externally supplied slag, i.e., slag from combustion plants nor incinerators where melting down is not possible, or flue dust, ash and the like from other installations. It is necessary to supply to the melting reactor the extraneous slag, ash, dust, and the like, to be melted down, using refuse as the energy carrier, with the materials being supplied having the energy quantity necessary for the maintenance of the melting down process. Preferably the extraneous materials to be added is in the form of refuse.

The extraneous material charging and melting down was tested by means of a recirculated material test. After a test in which domestic refuse alone was melted down and this test gave positive results, a further test was conducted investigating melting down of filter dust from the electrostatic precipitators of the plant. These was no addition of residue from flue gas cleaning (filter cake). However, it is possible to process such residues in the reactor according to the invention. It is assumed that if the essential fraction of heavy metals occurring during refuse incineration can permanently be melted down into slag (the basis being, e.g., an eluate test), this reduces the dumps of heavy metal containing material from the process, and consequently their capacities provided for this purpose. Harmful materials could be disposed of by melting down according to the invention by binding them in slag.

The addition of filter dust as recirculated material takes place by means of a specially produced, water-cooled lock construction fitted close to the revolving cylindrical furnace (charging point 6 in FIG. 1). The filter dust was introduced into the plant in charge form. For a specific time period, on average about 10% and then 20% of the refuse quantity was fed into the plant and melted down (cf. FIG. 3).

Due to an excessively large charging of waste material during the test, there was a slight rise in the dust quantity upstream of the electrostatic precipitator. Even if, which is improbable, the entire rise in the flue dust concentration in the flue gas could be attributed to the recirculated material, as a function of the temperature at least 91% thereof would be bound in the molten slag. This corresponds to approximately 82 to 182 kg of filter dust per metric ton of incinerated refuse. As compared with this, there is an "inherent" flue dust proportion during the incineration of a metric ton of waste of approximately 33 kg, which is approximately 3%. In other words, considerable quantities of toxic refuse from other plants, which would otherwise have to be expensively dumped, can be additionally disposed of with the aid of refuse in a melting down process according to the invention. FIG. 6 shows the approximate composition of the residual material quantity during the incineration of 1 metric ton of waste material.

Several samples of melted refuse slag were tested with an eluate test (CH-TVA test) with and without the addition of recirculated material, specifically with and without filter dust addition. The melted refuse slag without recirculated material addition not only fulfilled the TVA eluate test with respect to an inert material, it also had an ignition loss of only <0.1%. All the highly harmful hydrocarbon compounds such as dioxins, furans, etc., were below the detection limit. Evaluations show that the TVA limits for inert materials (eluate test) were not exceeded in all the samples tested. In both eluates (tests 1 and 2) the TVA limits for inert materials were not exceeded. Thus, with respect to the tested parameters, the slags complied with the official requirements.

During the test with filter dust addition, in addition to the regular measurements on the plant, in addition to the temperatures and moisture contents, the concentrations of the most important waste gas emittants were determined.

The dust concentration in the crude gas following the boiler, which in normal operation is in the center of the standard range, increased somewhat during the testing phase. This can be attributed to an increased charging of waste material due to inadequate control possibilities. However, the clean gas fulfills the TVA requirements of 17 BImSchV.

Nitrogen oxide or NOx emission during the test with filter dust addition was 2.5 times lower than in normal operation and was below the allowable level specified in Switzerland. The daily average value was approximately 141 $mg/m^3_n$, based on 11% $O_2$. The sulphur dioxide or SOx concentration in the clean gas rose during the test, which is probably due to the temperature-caused of metal sulphates.

The process according to the invention offers the possibility, without any energy supply from the outside, to melt down slag, ash and flue dust. As is shown by the eluate tests, the heavy metal compounds are insolubly bound into the slag. The melted slag also has a very low ignition loss and the dioxin values are below the detection limits. Melting not only takes place without any energy supply from the outside, but there is also a higher plant efficiency than in conventional incinerating plants. The plant offers the possibility of removing the waste incineration residues in a form not harmful to the environment and at the same time reduces disposal costs.

FIG. 2 shows the temperature gradient in the reactor measured during the test. The low temperature range in the generator is between about 600 and 1000° C. and the high temperature range in the revolving cylindrical furnace is between about 1000 to 1400° C. In the afterburning chamber and the empty flue, the temperature is controlled back to lower levels in order to completely lower it in a following battery of boilers for heat recovery and return. The continuous line indicates the thermal path of theoretical (ideal) combustion and the broken line the temperature path of the plant in standard operation. The dotted line path indicates the melting operation.

Figure 4:
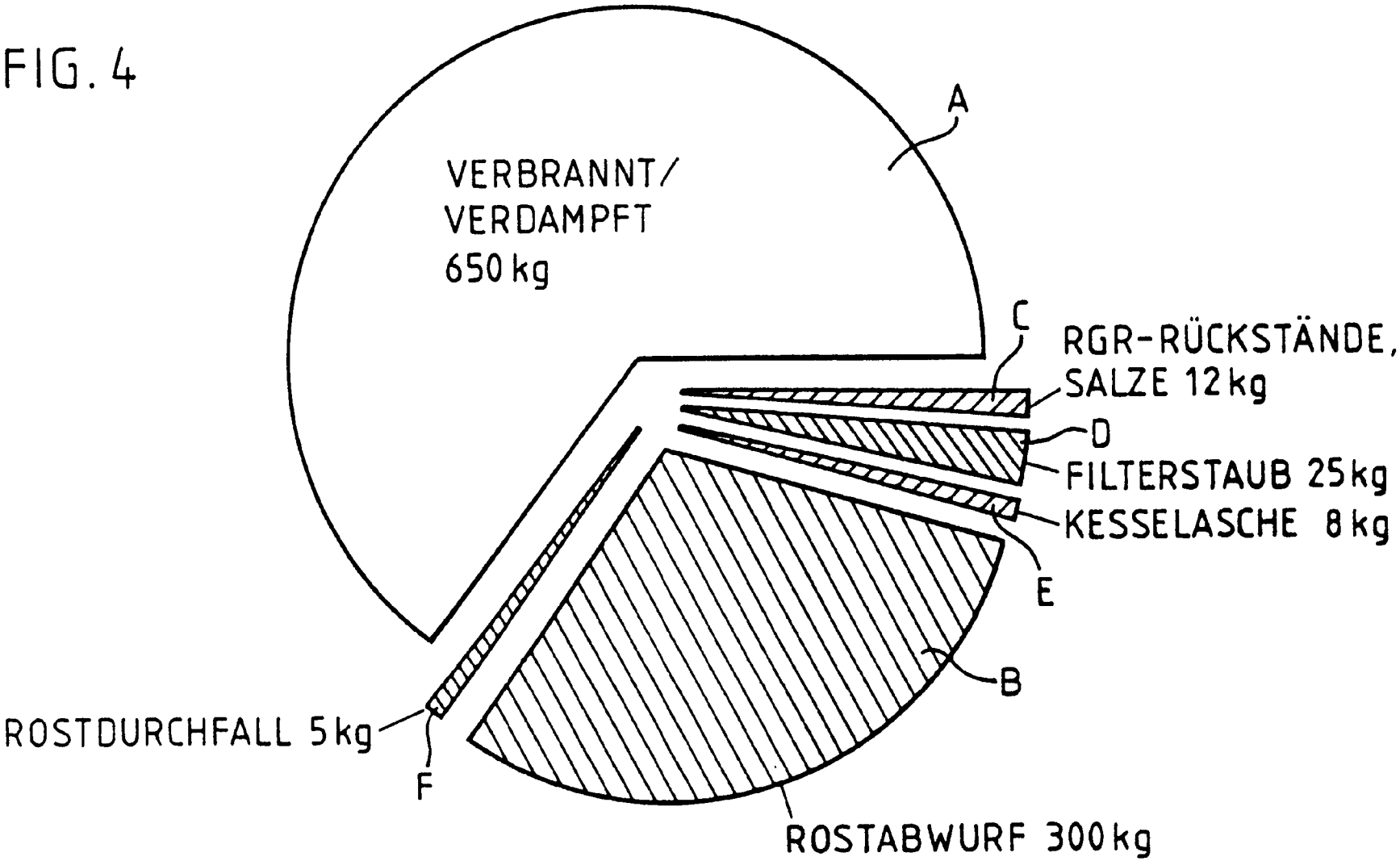
FIG. 4 is a chart of typical composition of the residual materials from one tonne of waste.

FIGS. 3 and 4 are charts essentially showing the mass passage and the associated energy sources. These diagrams give with absolute figures a specific course and composition dependent on the plant and the combustion material, but still demonstrate the effectiveness of the process according to the invention.

FIG. 3 is a diagram for filter dust supply within the test series discussed above. For somewhat more than two hours, the fractions were charged in two quantity ratios, at the start approximately 10% based on the refuse quantity and then approximately 20%. With automated addition, finer charging steps can be obtained.

FIG. 4 shows in the form of a Vehlow diagram an example of a composition of residual material quantities from one tonne of waste. This composition is, of course, largely dependent on the starting composition of the waste. The following letters identify the segments:

A=incinerated and vaporized fraction

B=material thrown off grate

C=flue gas cleaning gas residues (Also referred to as RGR-R)

D=filter dust

E=potash

F=riddlings.

What is claimed is:

1. A method of converting combustible waste materials to a product comprising substantially incombustible solid material comprising:

(a) feeding a combustible feed material, comprising solid waste material, into a primary reactor, (b) disposing said solid waste material on a grate in a lower portion of said primary reactor grate furnace (c) feeding grate air to said primary reactor from below said solid waste material therein, wherein said grate air comprises first oxygen in a quantity that is sub-stoichiometric with respect to said solid waste material and is sufficient to carbonize at least said solid waste material under conditions enabling production of a carbonized product comprising solid and gaseous carbonization products;

(d) maintaining said primary reactor under conditions sufficient to enable said sub-stoichiometric oxygen to carbonize said waste material, using energy in said feed waste material to support said carbonization, but insufficient to enable substantial incineration of said waste material, whereby producing a first reactor effluent comprising a combustible carbonized solid material and a combustible carbonization gas;

(e) feeding an incineration gas, comprising second oxygen into reaction proximity with substantially all of said first reactor effluent in a transition zone that is intermediate between said first reactor and a second reactor; wherein the total amount of oxygen fed to said transition zone is at least stoichiometric with respect to said carbonization product, (f) combining the entirety of said first reactor effluent with said incineration gas in said transition zone to form an intermediate feed; wherein the contents of said first reactor admixed with said incineration gas only exit said first reactor through said transition zone;

(g) burning said intermediate feed in a secondary reactor under conditions, including a temperature that is higher than the carbonization temperature in said primary reactor, and is sufficient to incinerate substantially all combustible material of said solid and gaseous carbonized material, sufficient to form an incineration product comprising a substantially non-combustible liquid-form slag and gaseous incineration products.

2. A method as claimed in claim 1 further comprising separating gaseous incineration products into combustible solid particles and flue gas, and recycling said combustible solid particles to said primary reactor.

3. A method as claimed in claim 2 further comprising recycling at least a portion of said combustible solid particles to said primary reactor and controlling the substoichiometry of oxygen in relation to the combination of said solid waste material and said recycled combustible solid particles.

4. A method as claimed in claim 2 further comprising utilizing energy in said incineration gas product to convert water into steam.

5. A method as claimed in claim 1 wherein at least one of said first and second oxygen is contained in air.

6. A method as claimed in claim 5 wherein said reaction temperatures and said oxygen stoichiometry are maintained such that production of NOX is reduced by about 50 to 70% as compared to the quantity of NOX that would have been produced if the grate furnace maximum temperature was above 1,000° C.

7. A method as claimed in claim 1 wherein the maximum grate furnace temperature is less than about 1,000° C.

8. A method as claimed in claim 7 wherein said grate furnace temperature is about 600 to less than about 1,000° C.

9. A method as claimed in claim 1 wherein said incineration temperature is sufficiently greater than 1,000° C. and said oxygen stoichiometry are sufficient to cause oxidation of substantially all organic components of said primary reactor effluent.

10. A method as claimed in claim 9 wherein said incineration temperature is about 1,000 to 1,400° C.

11. A method as claimed in claim 9 wherein said incineration temperature is about 1,300 to 1,400° C.

12. A method as claimed in claim 1 further comprising feeding carbonization gas to said primary reactor from above said solid waste material; wherein the relative proportions of grate air and carbonization gas, and the amount of oxygen introduced in each of the carbonization gas and the grate air, respectively, is substoichiometric with respect to said waste material and wherein the proportion of grate air and carbonization gas is controlled such that said primary reactor is maintained at a carbonization temperature below about 1,000° C.

13. A method as claimed in claim 1 further comprising feeding said incineration gaseous products into an afterburner and feeding additional gas comprising third oxygen into said afterburner in sufficient quantity to burn combustible components of said incineration gas product in said afterburner.

14. A method as claimed in claim 1 further comprising recycling riddlings passing through said grate into admixture with said combustible feed material and controlling the substoichiometry of oxygen fed to said primary reactor in consideration of recycled riddlings.

15. A method as claimed in claim 1 further comprising recirculating flue gas to said primary reactor.

16. A method as claimed in claim 1 further comprising, during start up of the claimed process, adding combustible material from an external source to said primary reactor and adjusting the oxygen sub-stoichiometry in relation to combustibles in said external combustible material and said solid waste material; and stopping the addition of said external combustible material when said claimed process become self sustaining.

17. A method as claimed in claim 1 comprising wherein heavy metals contained in said solid waste material become contained in said slag.

18. A method as claimed in claim 17 comprising recovering said slag as a liquid and solidifying said liquid slag into solid pellets comprising slag and including heavy metals.

19. A method as claimed in claim 1 further comprising recovering oxygen containing gas from said secondary reactor and recycling said recovered oxygen containing gas into said transition zone.

20. A method as claimed in claim 1 wherein said primary reactor and said secondary reactor are directly coupled to each other through said transition zone.

21. In a process for incinerating solid waste material that comprises carbonizing said solid waste material into a carbonization gas and solid carbonization product in a gas generating travelling grate reactor, and incinerating at least a portion of said solid carbonization product in a rotary kiln;

the improvement that comprises:

disposing said solid waste material on said travelling grate;

feeding oxygen containing grate air below said grate whereby combining said solid waste material with a sub-stoichiometric quantity of oxygen under low temperature conditions sufficient to carbonize said waste material on said grate and form still combustible solid residue on said grate and combustible gas above said grate while retaining a substantial portion of the energy contained in said solid waste material in said combustible solid residue and said combustible gas;

combining all of the contents of said travelling grate reactor, including said combustible solid residue and said combustible gas, with additional oxygen in a transition zone that is intermediate between said travelling grate and said rotary kiln, wherein the total amount of oxygen in said transition zone is at least stoichiometric with respect to combustible materials present in said transition zone;

passing the entire contents of said transition zone into said kiln and incinerating substantially all combustible values in said residue and gas in said kiln at a temperature that is higher than the temperature in said travelling grate; and recovering substantially incombustible residue.

22. A process of burning waste in a combustion plant having a gas generator equipped with a travelling grate and a following rotary kiln comprising the following sequence of steps:

disposing said waste on said travelling grate;

low temperature carbonizing said waste by contact with oxygen whereby heating said waste while on said travelling grate under such conditions that still combustible pyrolysis residue and combustible low temperature carbonization gasses form from said waste, continuously introducing an oxygen containing gas into said gas generator in a region of transition from the gas generator to the rotary kiln so that the pyrolysis residues, as well as the low temperature carbonization/combustion gas, together with added oxygen, continually pass through said transition region into the rotary kiln, wherein the only exit from said gas generator is through said transition region into said kiln; and maintaining a high enough temperature in said kiln to incinerate substantially all combustible components of said pyrolysis solid and said carbonization gas.

* * * * *